United States Patent [19]
Bareis et al.
[11] 4,318,325
[45] Mar. 9, 1982

[54] PRESS DRIVE ARRANGEMENT

[75] Inventors: Alfred Bareis, Uhingen; Ewald Bergmann, Rechberg-hausen; Hans-Martin Dommer, Goppingen, all of Fed. Rep. of Germany

[73] Assignee: L. Schuler Pressen GmbH, Goppingen, Fed. Rep. of Germany

[21] Appl. No.: 180,475

[22] Filed: Aug. 22, 1980

[30] Foreign Application Priority Data

Aug. 24, 1979 [DE] Fed. Rep. of Germany ..... 2934286

[51] Int. Cl.[3] ..... B26D 5/14; B26D 5/18

[52] U.S. Cl. ..... 83/530; 72/38; 83/615; 83/626; 83/630; 100/257; 100/286

[58] Field of Search ..... 83/615, 626, 628, 630, 83/530; 72/603, 25, 38, 40; 100/257, 282, 286

[56] References Cited

U.S. PATENT DOCUMENTS

| | | | |
|---|---|---|---|
| 2,753,937 | 7/1956 | Bottenhorn | 83/626 X |
| 3,450.038 | 6/1969 | Kraft et al. | 83/615 X |
| 4,156,387 | 5/1979 | Portmann | 100/257 |
| 4,160,409 | 7/1979 | Portmann | 74/603 X |

*Primary Examiner*—Frank T. Yost
*Attorney, Agent, or Firm*—Craig and Antonelli

[57] ABSTRACT

A press drive with a central cam shaft actively connected through a connecting rod with a slide guided in a linear guide. Side bars are symmetrically articulated with respect to each other on the slide. Mass balancing weights are driven in opposed directions corresponding to reciprocating masses of the press, with the weights being connected with the slide by other linkages. Pairs of toggle joint linkages are disposed symetrically with respect to the cam shaft. The pairs of toggle joint linkages include a first almost horizontally disposed toggle joint linkage that is articulated on the respective side bars and presents a bearing point on the press frame. A second almost vertically disposed toggle joint linkage that is connected with the first toggle joint linkage and is articulated so as to be guided by the press frame on the mass balancing weight. A third almost vertically disposed toggle joint linkage is articulated on the punch through a transmission bar with the first and second toggle joint linkages and is braced in a direction of motion of the punch on the press frame.

19 Claims, 4 Drawing Figures

PRESS DRIVE ARRANGEMENT

The present invention relates to a drive arrangement and, more particularly, to a press drive which includes a centrally disposed cam or crankshaft actively connected through a connecting rod with a slide guided in a linear guide, with side bars being articulated to the slide symmetrically to each other, through which bars a punch is indirectly movable by another articulated connection, and with mass balancing weights driven in opposed directions corresponding to reciprocating masses, which weights are connected with the slide by other linkages.

A press drive of the aforementioned type in, for example, Offenlegungsschrift 25 34 628 and corresponding U.S. Pat. No. 4,156,387, and such a press drive is especially designed for fast mechanical presses having a central cam shaft that is actively connected through a rod with a slide. On the slide there are side bars or one armed levers that are mutually and symmetrically linked, by which bars or levers the punch of the press is indirectly movable by another articulated connection. The one armed levers are borne on punch adjusting devices and, opposite the slide articulation, the adjusting devices are fixedly disposed on a frame of the press. Pressure rods that act between the punch and the one armed lever serve as additional articulated connections and mass balancing weights are provided that act through other linkages and double levers in opposed directions from the points of connection of the one armed lever with the pressure rods. The provision of the mass balancing weights makes it possible to realize a completely dynamic mass equilibrium. Additionally, there is provided a cam bushing that is rotatable with respect to the cam, which bushing serves as a conventional device for adjustment of the stroke of the punch.

The dynamic behavior of a press, especially when carrying out a cutting operation at a relatively high stroke speed, is quite unfavorably affected by the arrangement of the bearings in the flow of force or force path and by the arrangement of the one armed levers so that, among other things, a depth of penetration of the upper tool into a lower tool of a tool set of the press is increased as the stroke number increases since the number of bearings and also the elastic deformation of the one armed levers that are subjected to bending stresses considerably reduce the rigidity of the overall press system.

The aim underlying the present invention essentially resides in providing a press drive that has the minimum number of bearing disposed in the flow of force or force path, with completely dynamic balancing of masses and which utilizes structural parts in the flow of force that are exclusively subject to compressive and tensile stresses.

In accordance with advantageous features of the present invention, a press drive arrangement is provided wherein there is the provision symmetrically to the cam shaft of at least two of a first almost horizontally disposed toggle joint linkage means that is articulated on the respective side bars and presents a bearing point on the press frame, a second almost vertically disposed toggle joint means connected with the first toggle joint means and articulated so as to be guided by a press frame on a mass balancing weight, and a third almost vertically disposed toggle joint means which is articulated on a punch of a press and, through a transmission bar is connected with the first and second toggle joint means in addition to being braced in a direction of a motion of the punch on the press frame.

In accordance with further advantageous features of the present invention, the third toggle joint means, in a region of a lower reversal point of the punch of the press, attains its extended position with the first toggle joint means passing, at the same time, through its bent position.

Advantageously, a length ratio of the links of the second toggle joint means is equal to a length ratio of links of the third toggle joint means, with the second and third toggle joint means being moved in angular coordination or synchronism.

Preferably, the third toggle joint means is braced on the press frame through a punch adjustment means and a bearing point of the first toggle joint of the press frame is made as a stroke adjusting device.

In accordance with the present invention, a link borne on a bearing point of the first toggle joint is indirectly connected with the side bar by an extension member. Additionally, the side bar may be directly articulated on the link of the first toggle joint carried in the bearing point.

Advantageously, the stroke adjustment device of the present invention includes a slide disposed in a linear guide of the press frame. The slide may be movable by a central worm shaft through a threaded spindle and a worm gear.

The bearing point of the first toggle joint means in accordance with the present invention may be disposed on a lever that is fixed on the frame of the press but swingably mounted, with the lever being articulated through a connecting bar on a central slide that is movable through an adjusting spindle with a worm gear by another worm gear.

By virtue of a press drive arrangement in accordance with the present invention, the requirement for a minimum number of bearings lying in the flow or path of force has been met since only three bearings are provided per toggle joint means. Additionally, no structural parts subject to bending stresses are provided and, accordingly, the masses to be moved are reduced and a lighter construction can readily be achieved.

Moreover, the press drive of the present invention has a great rigidity that results in a reduction of tool wear because the depth of penetration and also the dynamic behavior of the press drive is positively affected. Additionally, if the press drive of the present invention is provided with a stroke adjusting device, a forward phase of a thrust device that is directly driven by a press drive is constant with an adjustment of the stroke of the punch.

Accordingly, it is an object of the present invention to provide a press drive arrangement which avoids, by simple means, shortcomings and disadvantages encountered in the prior art.

Another object of the present invention resides in providing a press drive arrangement which improves the dynamic behavior of a fast mechanical press.

Yet another object of the present invention resides in providing a press drive arrangement which minimizes the number of bearings disposed in a path of flow of force.

A further object of the present invention resides in providing a press drive arrangement which ensures a complete dynamic balancing of the reciprocating masses.

A still further object of the present invention resides in providing a press drive arrangement which is simple in construction and therefore relatively inexpensive to manufacture.

Yet another object of the present invention resides in providing a press drive arrangement which functions realiably under all operating conditions.

Another object of the present invention resides in providing a press drive arrangement which reduces the masses that need be moved and provides an overall lighter construction.

These and other objects, features, and advantages of the present invention will become more apparent from the following description when taken in connection with the accompanying drawing which shows, for the purposes of illustration only, several embodiments in accordance with the present invention, and wherein.

Figure 1:
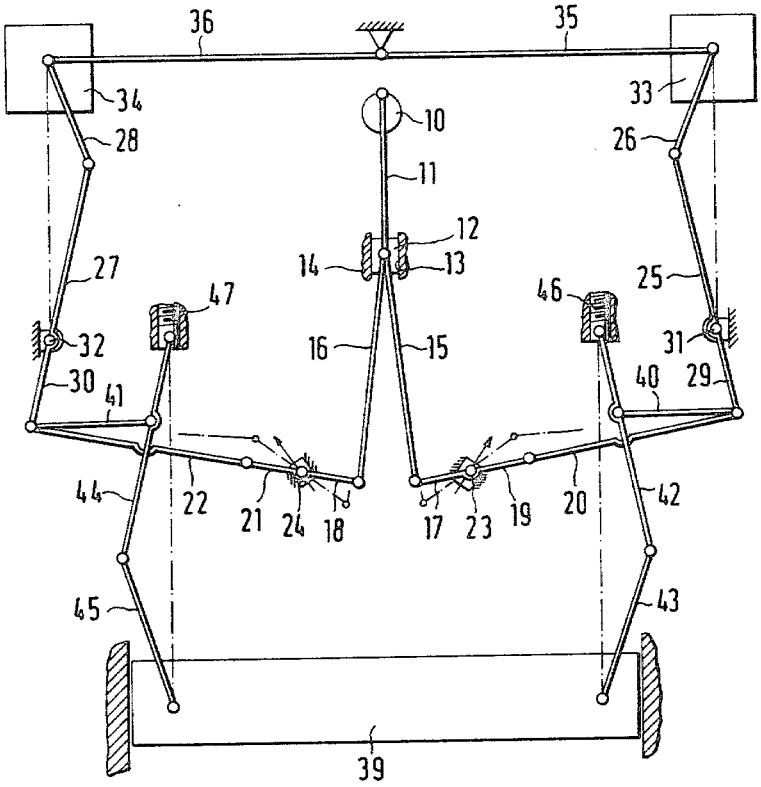
FIG. 1 is a schematic view of a press drive arrangement in accordance with the present invention.
Figure 2:
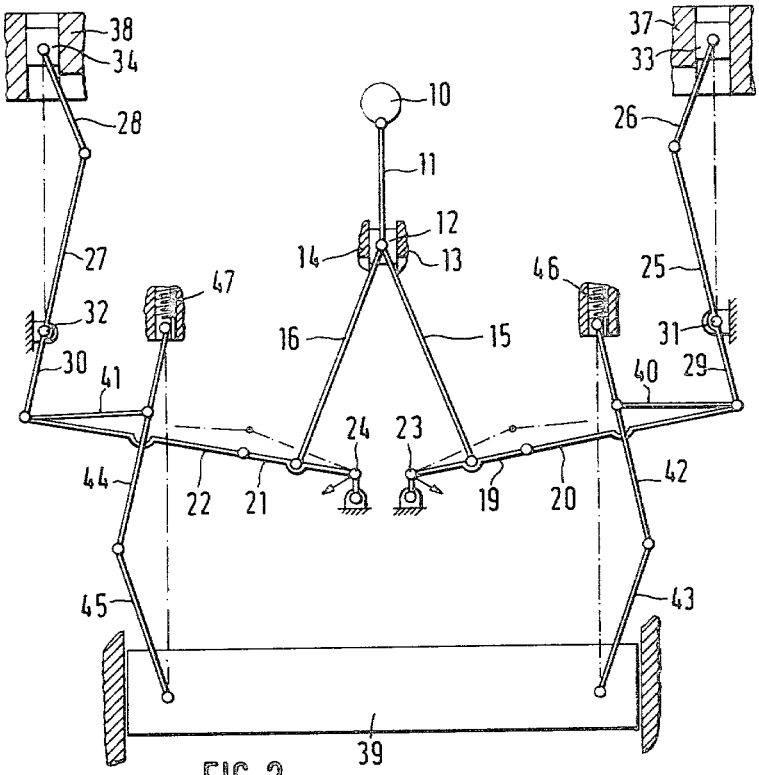
FIG. 2 is a schematic view of a further embodiment of a press drive arrangement in accordance with the present invention with a modified stroke adjustment means.

Referring now to the drawings wherein like reference numerals are used throughout the various views to designate like parts and, more particularly, to FIGS. 1 and 2, according to these FIGURES, a press drive arrangement is provided which includes a number of elements disposed symmetrically with respect to a crank or cam shaft 10. At least one connecting rod 11 is articulated on the shaft 10 and is connected with a slide 12 which is guided within a linear guide 13 in a press frame 14. The slide 12 is connected with two side bars 15, 16, with the side bars being connected in the embodiment of FIG. 1 through extension members 17, 18 with a first toggle joint linkage means which includes links 19, 20 and 21, 22. The first toggle joint linkage means is disposed substantially horizontally and the links 19, 21 of the linkage means are carried on bearing points 23, 24 fixed on the press frame, while the links 20, 21, through extension members 29, 30, are connected with a second toggle joint linkage means which includes links 25, 26 and 27, 28. The second toggle joint linkage means are disposed substantially vertically and the links 25, 27 of the second toggle joint linkage means and associated extension members 29, 30 are carried by bearings 31, 32 fixed on the press frame.

Links 26, 28 of the second toggle joint linkage means are articulatingly connected to mass balancing weights 33, 34 so as to enable the balancing weights to be guided by the press frame. In this connection, the phrase guided by the press frame means that the mass balancing weights 33, 34 are either guided on links 35, 36 along an arcuate path corresponding practically to tangents laid on the arcs or, as shown in FIG. 2, in linear guides 37, 38 fixed on the press frame and disposed parallel to the guides (not shown) of a punch 39.

The extension members 29, 30 are respectively connected with the links 20, 21 of the first toggle joint linkage means and are connected at the point of articulation of the links 19, 20 and 29, 30 with transmission rods 40, 41 which, in turn, are connected directly with a third toggle joint linkage means which includes links 42, 43 and 44, 45. The third toggle joint linkage means are disposed substantially vertically and the punch 39 is articulated on the links 43, 45; whereas, the links 42, 44 are carried or bear on conventional punch adjusting devices 46, 47 so as to be fixed on the press.

The press drive arrangement of FIG. 2 differs from the press drive arrangement of FIG. 1 in that, as noted above, linear guides 37, 38 are provided for guiding the respective mass balancing weights 33, 34. Additionally, the bearing points 23, 24 for the first toggle joint linkage means are connected to the first toggle joint linkage means in a different arrangement from that illustrated in FIG. 1. More particularly, as shown in FIG. 2, the extension members 17, 18 are eliminated so that the side bars 15, 16 are directly connected with the links 19, 21 of the first toggle joint linkage means.

For the press drive arrangement of FIG. 1 or the press drive arrangement of FIG. 2, the bearing points 23, 24 may be constructed as a stroke adjusting means.

Figure 3:
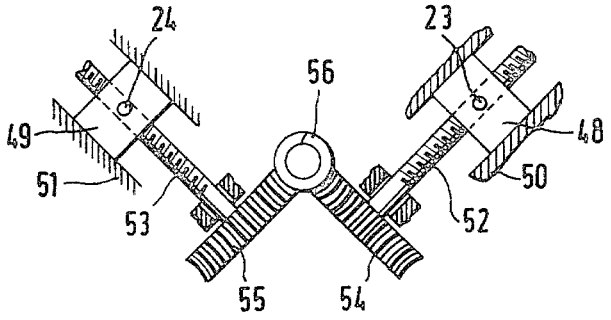
FIG. 3 is an enlarged cross sectional view of a stroke adjusting means for the press drive of FIG. 1.

More particularly, as shown in FIG. 3, a stroke adjusting means for the press drive arrangement of FIG. 1 includes slides 48, 49 which are guided in linear guides 50, 51 fixed to the frame of the press. The slides 48, 49 are adjustable in the linear guides 50, 51 by threaded spindles 52, 53. The threaded spindles 52, 53 are respectively provided, at ends of the spindles turned toward each other, with worm gears 54, 55. The worm gears 54, 55 are driven by a common central worm shaft 56 which is adapted to be moved either by a motor or manually through a crank or the like.

Figure 4:
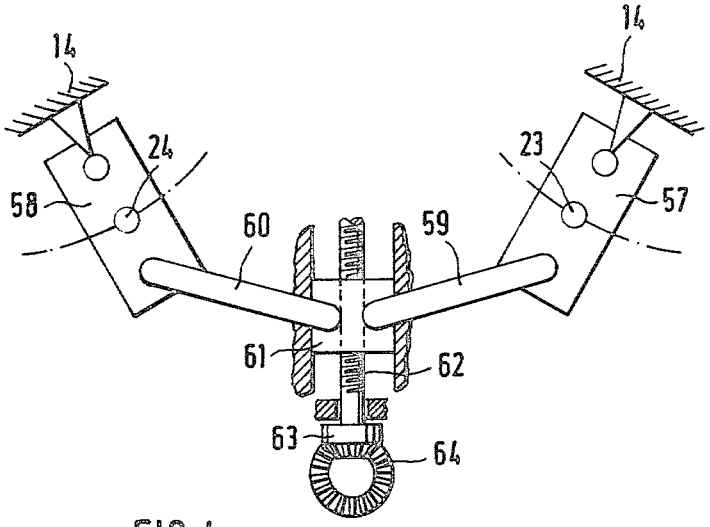
FIG. 4 is an enlarged cross sectional view of the stroke adjusting means for the press drive of FIG. 2.

FIG. 4 provides an example of a stroke adjustment device which may advantageously be employed in the press drive arrangement of FIG. 2. As shown in FIG. 4, the bearing points 23, 24 are disposed on levers 57, 58 that are fixed on the frame of the press but are swingably carried. The swingable or pivotable levers 57, 58 are connected with a central slide 61 through connecting bars 59, 60. The central slide 61 is adapted to be adjusted by a spindle 62 which is selectively driven by worm gears 63, 64. The worm gears 63, 64 may be driven by an electric motor or manually by a crank or the like.

The significance of the press drive arrangement of the present invention becomes more evident when compared with the conventional press drive arrangement proposed in the aforementioned German Publication. More particularly, with the two-point drive arrangement of the conventional press drive, there must be thirteen points of articulation or bearing points in the flow or path of force out of a total of thirty-one bearing points; however, with the press drive arrangement of the present invention, also with a total of thirty-one bearing points or points of articulation, only six points of articulation or bearing points are arranged in the flow or path of force, i.e., the minimum with two toggle joint linkage means.

In order to minimize the distortion of the path-time curve of the punch 39 influenced by the third toggle joint linkage means, the positions of the first toggle joint linkage means with the links 19, 20 and 21, 22 and the third toggle joint linkage means with links 42, 43 and 44, 45 are so selected that when a lower reversal point of the punch 39 is reached, the third toggle joint linkage means, that is, links 42, 43 and 44, 45, pass through their extended position while the first toggle joint linkage means, that is, links 19, 20 and 21, 22 pass through their bending points. The links 25, 26 and 27, 28, at the same time, pass the extended position so that it is possible to obtain a condition of equality of length ratios of the links 25, 26 and 27, 28 of the second toggle joint linkage means and links 42, 43 and 44, 45 of the third toggle joint linkage means and a corresponding dimensioning of the mass balancing weights 33, 34 of all the links and bars of the press drive is balanced.

The links 25, 26 and 27, 28 of the second toggle joint linkage means are moved in a precise angular coordination or synchronism with the links 42, 43 and 44, 45 of the third toggle joint linkage means in the embodiments of the present invention as opposing pairs; however, the press drive can be so constructed that the second and third toggle joint linkage means will be driven in the same direction as pairs but laterally in opposition.

If the bearing points 23, 24 are constructed as stroke adjusting means, with a change of stroke there is automatically a change of stroke of the mass balancing weights 33, 34 articulated on the links 25, 26 and 27, 28 of the second toggle joint linkage means.

While we have shown and described several embodiments in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. A press drive which includes a central cam shaft means, a slide guided in a linear guide of a press frame, a connecting rod means for connecting the central cam shaft means with said slide, a pair of side bar means symmetrically articulated to the slide for indirectly moving a punch of the press, and balancing weight means driven in an opposed direction to reciprocating masses of the press, characterized in that a pair of first toggle joint linkage means are respectively disposed symmetrically to the cam shaft means, each of said pair of first toggle joint linkage means extends substantially horizontally and is respectively articulated to one of the side bar means supported by a bearing means disposed at the frame of the press, a pair of second toggle linkage means are respectively disposed symmetrically to the cam shaft means, each of said pair of second toggle joint linkage means extends substantially vertically and is articulated to the respective second toggle joint linkage means and the balancing weight means, means are provided for enabling each of the second toggle joint linkage means to be guided by the frame of the press, a pair of third toggle joint linkage means are respectively disposed symmetrically with respect to the cam shaft means, each of said pair of third toggle joint linkage means extends substantially vertically and is articulated to the punch and is braced in a direction of motion of the punch on the frame of the press, and in that a transmission bar means is provided for articulatingly connecting each of the third toggle joint linkage means with the respective first and second toggle joint linkage means.

2. A press drive according to claim 1, characterized in that the third toggle joint linkage means and first toggle joint linkage means are arranged such that in a region of a lower reversal point of the punch, the third toggle joint linkage means attains an extended position with the first toggle joint linkage means passing at the same time through a bent position.

3. A press drive according to one of claims 1 or 2, characterized in that a length ratio of links of the second toggle joint means is equal to a length ratio of links of the third toggle joint linkage means, and in that the second toggle joint linkage means and third toggle joint linkage means are movable in synchronism.

4. A press drive according to claim 3, characterized in that a punch adjustment means is provided for bracing the respective linkage means on the press frame.

5. A press drive according to claim 4, characterized in that a stroke adjusting means is provided for each first toggle joint linkage means, and in that the stroke adjusting means forms the bearing means at which the first toggle joint linkage means are supported at the press frame.

6. A press drive according to claim 5, characterized in that an extension means is provided for indirectly connecting the respective first toggle joint linkage means to the side bar means.

7. A press drive according to claim 6, characterized in that the extension means is connected to a link of the respective first toggle joint linkage means supported by the bearing means.

8. A press drive according to claim 5, characterized in that the respective first toggle joint linkage means in directly articulated to the respective side bar means.

9. A press drive according to claim 8, characterized in that the respective side bar means are directly articulated to a link of the respective first toggle joint linkage means supported by the bearing means.

10. A press drive according to claim 9, characterized in that each stroke adjusting means includes a slide member disposed in the linear guide of the press frame, and means are provided for enabling an adjustment of the respective slide members in the linear guide.

11. A press drive according to claim 10, characterized in that the means for enabling adjustment includes a threaded spindle cooperable with an associated slide member, worm gear means provided on each of the threaded spindles, and a centrally disposed worm shaft for driving the worm gear means and threaded spindles.

12. A press drive according to claim 9, characterized in that each stroke adjusting means includes a lever pivotably mounted on the press frame, a slide member disposed centrally of the levers, means for connecting the respective levers with the slide member, and means for enabling an adjustment of the slide member.

13. A press drive according to claim 12, characterized in that the means for connecting the respective levers with the slide member includes a connecting bar interposed between the slide member and respective levers, each of the connecting bars are articulatingly connected with the respective levers and the slide member, and in that the means for enabling an adjustment of the slide member includes a threaded spindle cooperable with the slide member, and a worm gear drive means for driving the threaded spindle.

14. A press drive according to one of claims 1 or 2, characterized in that a stroke adjusting means is provided for each first toggle joint linkage means, and in that the stroke adjusting means forms the bearing means at which the first toggle joint linkage means are supported at the press frame.

15. A press drive according to claim 14, characterized in that each stroke adjusting means includes a slide member disposed in the linear guide of the press frame, and means are provided for enabling an adjustment of the respective slide members in the linear guide.

16. A press drive according to claim 14, characterized in that each stroke adjusting means includes a lever pivotably mounted on the press frame, a slide member disposed centrally of the levers, means for connecting the respective levers with the slide member, and means for enabling an adjustment of the slide member.

17. A press drive according to one of claims 1 or 2, characterized in that a punch adjustment means is provided for bracing the respective linkage means on the press frame.

18. A press drive according to one of claims 1 or 2, characterized in that an extension means is provided for indirectly connecting the respective first toggle joint linkage means to the side bar means.

19. A press drive according to one of claims 1 or 2, characterized in that the respective first toggle joint linkage means is directly articulated to the respective side bar means.

* * * * *